US007708260B2

(12) United States Patent
Eicher et al.

(10) Patent No.: US 7,708,260 B2
(45) Date of Patent: May 4, 2010

(54) AUXILIARY HANDLE DEVICE

(75) Inventors: Roswitha Eicher, Filderstadt (DE); Stefan Heess, Leinfelden-Echterdingen (DE); Joerg Maute, Sindelfingen (DE); Florian Esenwein, Uhingen-Holzhausen (DE); Bernhard Eicher, Filderstadt (DE); Marcus Schuller, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/132,317

(22) Filed: Jun. 3, 2008

(65) Prior Publication Data

US 2009/0038899 A1 Feb. 12, 2009

(30) Foreign Application Priority Data

Aug. 6, 2007 (DE) ..... 10 2007 037 048

(51) Int. Cl.
*B25D 17/00* (2006.01)

(52) U.S. Cl. ..... 267/207; 267/205; 173/162.2

(58) Field of Classification Search ..... 188/129, 188/371–374; 267/205, 207; 173/162.1, 173/162.2, 170; 16/431, 436
See application file for complete search history.

(56) References Cited

U.S. PATENT DOCUMENTS

| | | | | |
|---|---|---|---|---|
| 2,819,063 | A * | 1/1958 | Neidhart | 267/292 |
| 3,160,233 | A * | 12/1964 | Norman et al. | 188/268 |
| 3,696,891 | A * | 10/1972 | Poe | 188/268 |
| 3,845,827 | A * | 11/1974 | Schulin | 173/162.1 |
| 4,385,665 | A * | 5/1983 | Knoll | 173/162.1 |
| 4,650,167 | A * | 3/1987 | Steiner et al. | 267/137 |
| 5,157,807 | A * | 10/1992 | Keller et al. | 16/431 |
| 6,454,063 | B1 * | 9/2002 | Osterberg et al. | 188/379 |
| 6,467,376 | B1 * | 10/2002 | Wu | 81/22 |
| 7,137,542 | B2 * | 11/2006 | Oki et al. | 173/162.2 |
| 2006/0219419 | A1 * | 10/2006 | Sugiyama et al. | 173/162.2 |
| 2008/0190632 | A1 * | 8/2008 | Berger et al. | 173/162.2 |

* cited by examiner

*Primary Examiner*—Christopher P Schwartz
(74) *Attorney, Agent, or Firm*—Michael J. Striker

(57) ABSTRACT

An auxiliary handle device, in particular for a hand-held power tool, has an auxiliary handle and a damping unit with at least one absorber mass element. The absorber mass element is designed in the shape of a sleeve along a main extension direction of the auxiliary handle device.

14 Claims, 5 Drawing Sheets

AUXILIARY HANDLE DEVICE

CROSS-REFERENCE TO A RELATED APPLICATION

The invention described and claimed hereinbelow is also described in German Patent Application 10 2007 037 048.4 filed on Aug. 6, 2007. This German Patent Application, whose subject matter is incorporated here by reference, provides the basis for a claim of priority of invention under 35 U.S.C. 119(a)-(d).

BACKGROUND OF THE INVENTION

The present invention is directed to an auxiliary handle device.

An auxiliary handle device for a hand-held power tool is already known, the auxiliary handle device including an auxiliary handle and a damping unit. The damping unit includes an absorber mass element that serves to dampen vibrations.

SUMMARY OF THE INVENTION

The present invention is directed to an auxiliary handle device, in particular for a hand-held power tool, with an auxiliary handle and a damping unit that includes at least one absorber mass element.

It is provided that the absorber mass element is designed in the shape of a sleeve along a main extension direction of the auxiliary handle.

In this context, an "auxiliary handle" is understood to be a region and/or a component and/or an element provided for placement—and enclosing, in particular—by one or two hands of an operator for guiding a hand-held power tool using an auxiliary handle device, and which is capable of being attached to the hand-held power tool in an auxiliary manner, adjacent to a further handle, in particular the main handle, the auxiliary handle device being located on the side of the hand-held power tool, and/or being capable of being removed from the hand-held power tool by an operator without the use of tools, and/or being located in a front region of the hand-held power tool close to the tool, and/or the auxiliary handle is designed in the shape of a rod.

An "absorber mass element" refers, in particular, to an element that is excited—at least within one intended frequency range of an initial oscillation and/or excitation oscillation—to generate a counter-oscillation that counteracts the initial or excitation oscillation, and therefore contributes to a reduction of vibrations. "Along a main extension direction of the auxiliary handle" is understood to mean an orientation and/or placement of the absorber mass element in particular, the length of the absorber mass element being oriented preferably parallel to the main extension direction and/or to a length of the auxiliary handle. The inventive design provides an advantageous damping of the auxiliary handle—of the gripping region in particular—and, therefore, a high level of operating comfort for an operator. In particular, vibrations may be advantageously damped along a preferred direction, e.g., along the main extension direction. The inventive auxiliary handle device is basically usable in conjunction with all hand-held power tools that appear reasonable to one skilled in the technical art, thereby making it easier, in particular, for an operator to guide hand-held power tools using the auxiliary handle. Due to its damping property, the auxiliary handle device is particularly advantageous when used with an angle grinder.

It is also provided that the auxiliary handle includes a grip sleeve that serves as a receiving area for receiving the absorber mass element, thereby providing a receiving function with a simple design and making it possible to locate the damping unit and/or the absorber mass element inside the auxiliary handle device in a particularly space-saving manner.

When the grip sleeve is supported in a radial and/or axial direction via the absorber mass element, an undesired and, in particular, direct transfer of vibrations from the hand-held power tool to the grip sleeve may be prevented. The grip sleeve is preferably located around the absorber mass element, thereby ensuring advantageous support of the grip sleeve in the radial and/or axial direction via the absorber mass element.

In a further embodiment of the present invention, it is provided that the damping unit includes at least one damping element that supports the absorber mass element in at least one direction, thereby making it possible to attain an advantageous, vibration-damping support of the absorber mass element along an axial and/or radial direction of the auxiliary handle. The axial direction is preferably oriented parallel with the main extension direction of the auxiliary handle, and the radial direction is oriented radially outwardly from an auxiliary handle axis that extends parallel with the main extension direction.

An advantageous support of the absorber mass element that enables a counter-oscillation to be generated may be attained when the damping element is a rolling element. The rolling element is preferably designed as a bearing, a ring, and/or further rolling elements that appear reasonable to one skilled in the technical art.

An advantageous support of the absorber mass element may also be attained when the damping element is made of an elastomer and/or a ring and/or a damping fluid. The elastomer preferably encloses a rubber-like, elastic material. The damping fluid is advantageously a pure fluid, a suspension, and/or further damping fluids that appear reasonable to one skilled in the technical art.

In an advantageous refinement of the present invention, it is provided that the damping unit includes at least one adjusting element that is provided for adjusting at least one damping parameter of the damping element. With this, the damping parameter may be advantageously adapted to an oscillatory behavior of the hand-held power tool. It is advantageously provided that the damping parameter is adjusted by an operator of the auxiliary handle device.

It is also provided that the damping unit includes at least a second sleeve-shaped absorber mass element, thereby ensuring that particularly effective damping of vibrations may be attained via the damping unit when the hand-held power tool and/or the auxiliary handle device are operated.

Particularly advantageous damping inside the auxiliary handle device that is adapted to a different oscillatory behavior, e.g., different oscillation frequencies in particular, may be attained when the different absorber mass elements have different damping properties. The absorber mass elements differ preferably in terms of the material, mass, volume or shape, and/or in terms of other properties that appear reasonable to one skilled in the art. The different properties of the individual absorber mass elements result in different damping properties.

A particularly compact damping unit with a particularly space-saving arrangement of the individual absorber mass elements may be advantageously attained when at least one of the sleeve-shaped absorber mass elements is located at least partially inside a further sleeve-shaped absorber mass element. The sleeve-shaped absorber mass element is preferably supported inside the further sleeve-shaped absorber mass element using a damping element, e.g., using an elastomer ring and/or further damping elements that appear reasonable to one skilled in the art.

It is also provided that at least one absorber mass element includes a segment-like projection in a radial direction, thereby making it possible to integrate an advantageous unbalanced mass for generating a counter-oscillation inside the damping unit. In this context, a "segment-like projection" refers, in particular, to a projection that preferably extends around a circular segment by a maximum of 180°, particularly advantageously by a maximum of 90°, and particularly preferably, it extends around a circular segment by a maximum of 45°, and/or is designed in the shape of a peg in particular.

DESCRIPTION OF THE PREFERRED EMBODIMENTS

Figure 1:
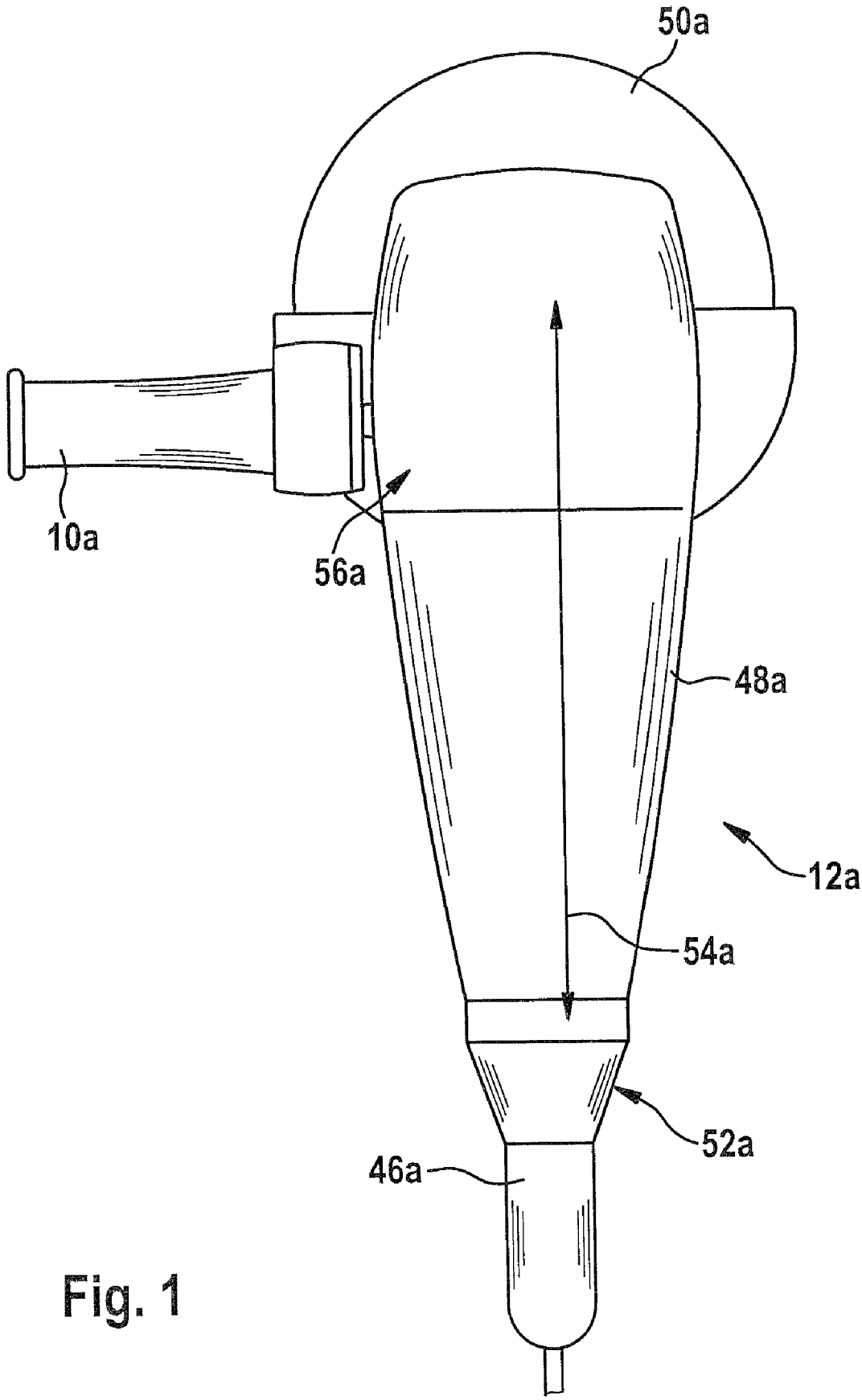
FIG. 1 shows a hand-held power tool with an inventive auxiliary handle device, in a schematic depiction.

A hand-held power tool 12*a* designed as an angle grinder is shown in FIG. 1, in a perspective view from above. Angle grinder includes a housing 48*a* and a main handle 46*a* integrated in housing 48*a*. Main handle 46*a* extends along a side 52*a* facing away from a tool 50*a* that is a cutting disk, in a longitudinal direction 54*a* of the angle grinder. An auxiliary handle device 10*a* is located in a front region 56*a* of the angle grinder that is close to the tool, and extends transversely to longitudinal direction 54*a* of the angle grinder.

Figure 2:
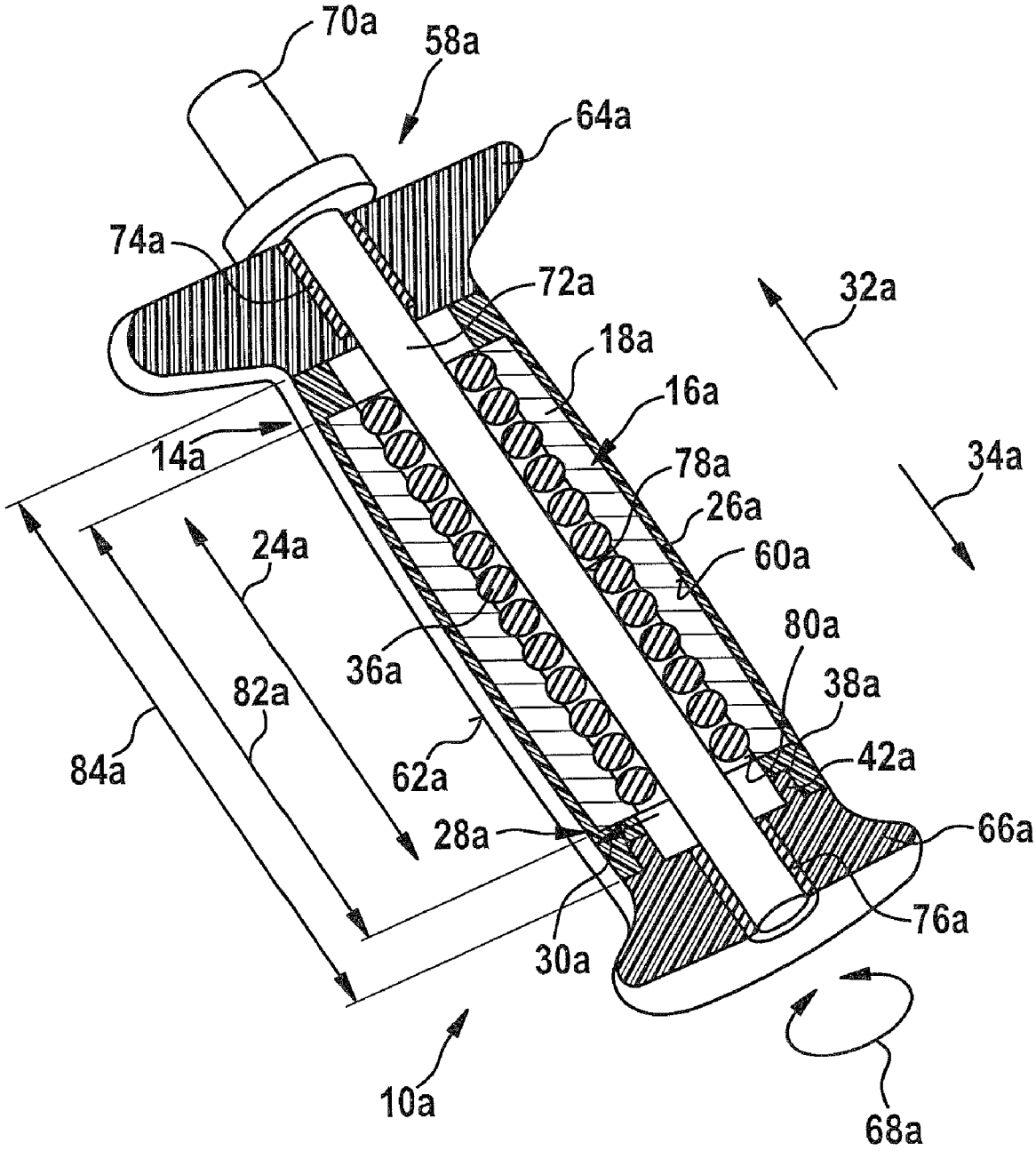
FIG. 2 shows the auxiliary handle device with an inventive damping unit, in a sectional view.

FIG. 2 shows auxiliary handle device 10*a* with an auxiliary handle 14*a*, a fastening unit 58*a*, and a damping unit 16*a*. Additional handle 14*a* includes a grip sleeve 26*a*, which extends along a main extension direction 24*a* of auxiliary handle device 10*a*. Grip sleeve 26*a* forms—together with a radially inwardly facing surface 60*a*—a receiving area 28*a*, which is provided to receive damping unit 16*a*. Receiving area 28*a* is designed cylindrical in shape along main extension direction 24*a*. Auxiliary handle 14*a* and/or grip sleeve 26*a* has a surface 62*a* that is curved radially outwardly along main extension direction 24*a* of auxiliary handle 14*a*, thereby providing a particularly good grip for an operator of auxiliary handle device 10*a*.

A ridge-type raised area is provided along main extension direction 24*a* in end regions 64*a*, 66*a* of auxiliary handle device 14*a*, which limits a gripping region of grip sleeve 26*a* for an operator of auxiliary handle device 10*a* along main extension direction 24*a*. The two ridge-type raised areas are located on auxiliary handle 14*a* in the manner of rings, in a circumferential direction 68*a*, which extends perpendicularly to main extension direction 24*a*. The two ridge-type raised areas extend radially outwardly from auxiliary handle 14*a*. During operation of auxiliary handle device 10*a*, ridge-type raised areas prevent the operator's hand from slipping when the operator guides hand-held power tool 12*a* using auxiliary handle device 10*a* and/or while force is being transmitted by the operator via auxiliary handle device 10*a* to hand-held power tool 12*a*.

Fastening unit 58*a*, which is designed to be screwed together with hand-held power tool 12*a*, includes a bolt-shaped fastening element 70*a*. A support element 72*a* abuts fastening unit 58*a* and extends in main extension direction 24*a* through end region 64*a* facing fastening unit 58*a* and through receiving area 28*a*, and is fastened to end region 66*a* facing away from fastening unit 58*a*. Support element 72*a* is designed as a single piece with fastening unit 58*a*. Damping elements 74*a*, 76*a* made of an elastomer are located in a radial direction 30*a* between support element 72*a* and end regions 64*a*, 66*a*. Damping elements 74*a*, 76*a* prevent a direct transfer of oscillations from support element 72*a* to end regions 64*a*, 66*a* and, therefore, to grip sleeve 26*a*.

Damping unit 16*a* includes a sleeve-shaped absorber mass element 18*a*, which is located inside receiving area 28*a* along main extension direction 24*a* of auxiliary handle device 14*a*. Absorber mass element 18*a* is located around support element 72*a*, in radial direction 30*a*. To provide an additional vibration damping effect, further damping elements 36*a* are located along a path of vibration transmission from support element 72*a* in radial direction 30*a* outwardly to absorber mass element 18*a*. Damping elements 36*a* are formed by rolling elements designed as elastomer balls. It is also basically feasible for damping elements 36*a* to be designed as elastomer rings and/or as further rolling elements that appear reasonable to one skilled in the technical art.

The elastomer balls bear against a radially outwardly oriented surface 78*a* of support element 72*a* and against a radially inwardly oriented surface 80*a* of absorber mass element 18*a*. Absorber mass element 18*a* is thereby supported relative to support element 72*a* via the elastomer balls. Damping elements 36*a*, i.e., the elastomer balls, dampen vibrations and/or absorb oscillation energy. The oscillation energy is at least partially absorbed and converted into internal friction energy of the elastomer balls and/or into external friction energy when the elastomer balls move relative to support element 72*a*. Absorber mass element 18*a* abuts the elastomer balls outwardly in radial direction 30*a*. Absorber mass element 18*a* is provided to generate a counter-oscillation and/or vibration that opposes an initial oscillation of hand-held power tool 12*a*. Absorber mass element 18*a* is designed to absorb vibrations preferably in an axial direction 32*a*, 34*a*, which is oriented parallel with main extension direction 24*a* of auxiliary handle 14*a*. Absorber mass element 18*a* has a length 82*a* that is shorter than a length 84*a* of receiving area 28*a*, thereby enabling counter-oscillations to be generated in axial direction 32*a*, 34*a* during operation of hand-held power tool 12*a*.

Grip sleeve 26*a* abuts sleeve-shaped absorber mass element 18*a* outwardly in radial direction 30*a*. Grip sleeve 26*a* is supported by absorber mass element 18*a* in radial direction 30*a* and is formed by an elastic coating around absorber mass element 18*a* applied via injection molding. The elastic coating is also located inside receiving area 28*a* between absorber mass element 18*a* and end regions 64*a*, 66*a*. The elastic coating serves as damping element 38*a* and essentially prevents a direct transmission of vibrations from support element 72*a* and/or end regions 64*a*, 66*a* to grip sleeve 26*a* during operation of hand-held power tool 12*a* and/or auxiliary handle device 10*a*. The elastic coating of receiving area 28*a* also forms a closed space, which may be filled with a damping fluid to further enhance a vibration-damping property of damping unit 16*a*. To adjust a damping parameter of damping element 38*a* and/or to adjust a maximum counter-oscillation of absorber mass element 18*a*, end region 66*a* facing away from fastening unit 58*a* is provided with a threaded adjusting element 42*a*, which is screwed together with damping element 38*a*. Length 84*a* of receiving area 28*a* may be adjusted using adjusting element 42*a*. It is also feasible, however, for grip sleeve 26*a*—together with absorber mass element 18*a*—to be located at a distance from end regions 64*a*, 66*a*, and for grip sleeve 26*a* to therefore be located such that it is decoupled from vibrations from end regions 64*a*, 66*a*.

Figure 3:
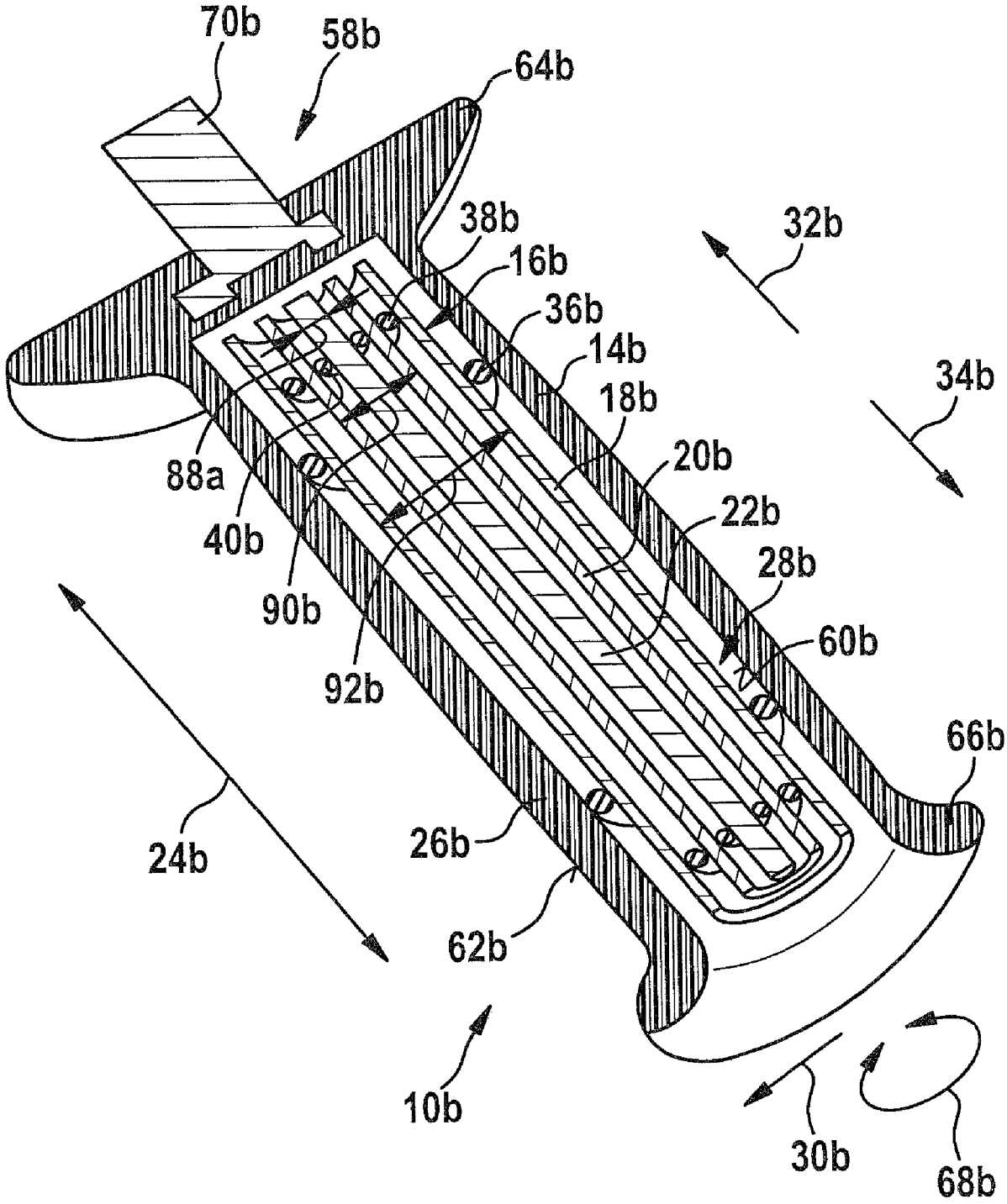
FIG. 3 shows the auxiliary handle device with an alternative damping unit that includes several absorber mass elements, in a sectional view.
Figure 4:
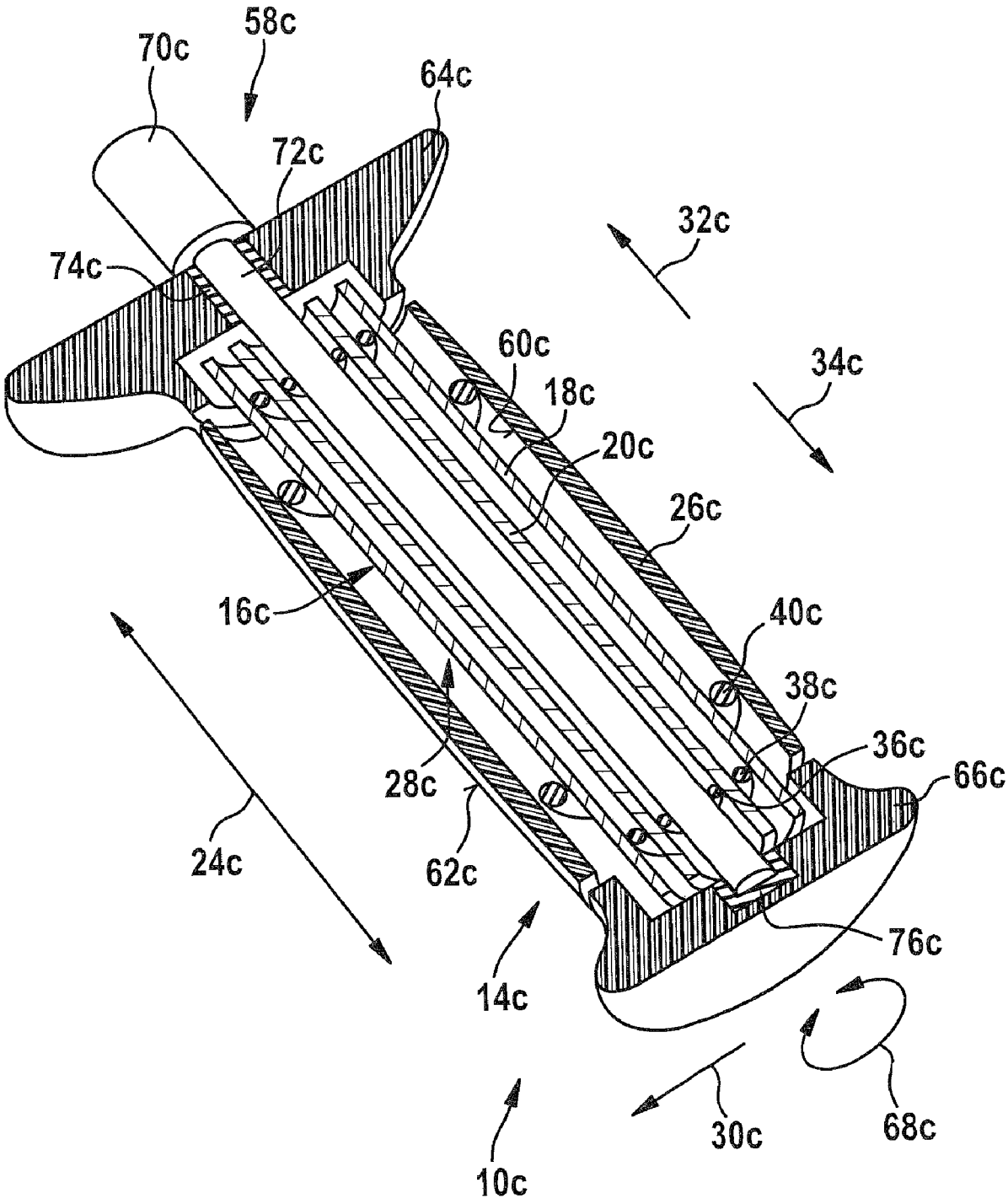
FIG. 4 shows the auxiliary handle device with an alternative damping unit that includes a grip sleeve supported by absorber mass elements, in a sectional view.
Figure 5:
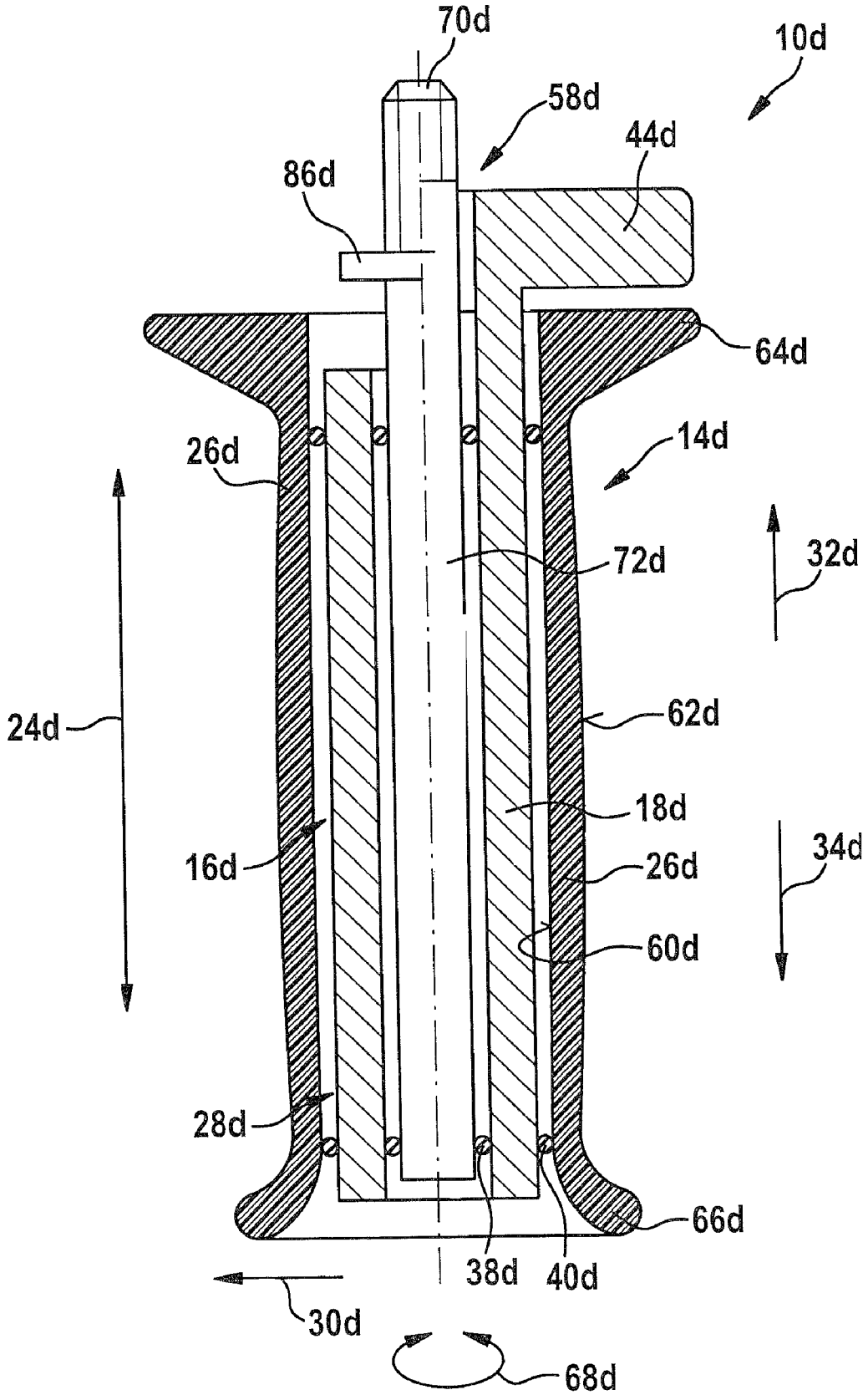
FIG. 5 shows the auxiliary handle device with an alternative damping unit that includes a segment-like unbalanced mass, in a sectional view.

Alternative exemplary embodiments are shown in FIGS. 3 through 5. Components, features, and functions that are essentially the same are labeled with the same reference numerals. To distinguish the exemplary embodiments from each other, the reference numerals of the exemplary embodiments are appended with the letters a through d. The description below is essentially limited to the differences from the exemplary embodiment in FIGS. 1 and 2. With regard for the components, features, and functions that remain the same, reference is made to the description of the exemplary embodiment shown in FIGS. 1 and 2.

FIG. 3 shows an alternative auxiliary handle device 10*b* with a damping unit 16*b* that includes three sleeve-shaped absorber mass elements 18*b*, 20*b*, 22*b*. The three absorber mass elements 18*b*, 20*b*, 22*b* are located inside a receiving area 28*b* of an auxiliary handle 14*b* of auxiliary handle device 10*b*. Receiving area 28*b* is designed open in axial direction 34*b* at an end region 66*b* facing away from a fastening unit 58*b*. Fastening unit 58*b* includes a fastening element 70*b*, which is connected with an end region 64*b* facing fastening unit 58*b* via a form-fit, non-positive, and/or bonded connection.

The three absorber mass elements 18*b*, 20*b*, 22*b* differ in terms of their masses and diameters 88*b*, 90*b*, 92*b*. The three absorber mass elements 18*b*, 20*b*, 22*b* may also differ in terms of a material and/or other properties that appear suitable to one skilled in the technical art. Absorber mass element 22*b* with the smallest diameter 88*b* is enclosed outwardly in a radial direction 30*b* by absorber mass element 20*b* with mid-range diameter 90*b*. In turn, absorber mass element 20*b* is enclosed by absorber mass element 18*b* with greatest diameter 92*b*. Damping elements 38*b*, 40*b* designed as elastomer rings are located between absorber mass elements 18*b*, 20*b*, 22*b* in radial direction 30*b* to support individual absorber mass elements 18*b*, 20*b*, 22*b* relative to each other. In order to provide equal support to absorber mass elements 18*b*, 20*b*, 22*b* along a main extension direction 24*b* of auxiliary handle 14*b*, annular damping elements 36*b*, 38*b*, 40*b* are located between absorber mass elements 18*b*, 20*b*, 22*b*, and between absorber mass element 18*b* and grip sleeve 26*b* in regions of receiving area 28*b* facing end regions 64*b*, 66*b*.

In order to attach absorber mass elements 18*b*, 20*b*, 22*b* inside receiving area 28*b*, damping elements 36*b*, 38*b*, 40*b* are integrally extruded with grip sleeve 26*b* and absorber mass elements 18*b*, 20*b*, 22*b*. It is also basically feasible for damping elements 36*b*, 38*b*, 40*b* to be clamped between absorber mass elements 18*b*, 20*b*, 22*b* and/or between absorber mass element 18*b* and grip sleeve 26*b*, thereby securing absorber mass elements 18*b*, 20*b*, 22*b* in axial direction 32*b*, 34*b* inside receiving area 28*b* using pressure-generated tension. It is also feasible for receiving area 28*b* to be closed to the outside at end region 66*b* facing away from fastening unit 58*b*, and for absorber mass elements 18*b*, 20*b*, 22*b* to also be supported in a damping fluid.

FIG. 4 shows an alternative auxiliary handle device 10*c* with a damping unit 16*c* that includes two sleeve-shaped absorber mass elements 18*c*, 20*c*. In contrast to the exemplary embodiment shown in FIG. 3, a fastening unit 58*c* is designed as a single piece with a support element 72*c* that extends through a receiving area 28*c* along a main extension direction 24*c* of an auxiliary handle 14*c*. The two absorber mass elements 18*c*, 20*c* are located around support element 72*c*, outwardly in a radial direction 30*c*. Damping elements 36*c*, 38*c* designed as elastomer rings are located between absorber mass elements 18*c*, 20*c* and/or between absorber mass element 20*c* and support element 72*c*. Damping elements 36*c*, 38*c* are applied to absorber mass elements 18*c*, 20*c* and/or support element 72*c* via injection molding. It is also basically feasible, however, for damping elements 36*c*, 38*c* to be clamped between absorber mass elements 18*c*, 20*c* and/or between absorber mass element 20*c* and support element 72*c*. A grip sleeve 26*c* of auxiliary handle 14*c* is supported relative to absorber mass element 18*c* in radial direction 30*c* via integrally extruded damping elements 40*c* designed as elastomer rings. Grip sleeve 26*c* is separated from end regions 64*c*, 66*c* of auxiliary handle 14*c* along main extension direction 24*c*, thereby ensuring that grip sleeve 26*c* is vibration-decoupled or vibration-damped relative to end regions 64*c*, 66*c* in axial direction 32*c*, 34*c*.

FIG. 5 shows an alternative auxiliary handle device 10*d* with a damping unit 16*d* that includes a sleeve-shaped absorber mass element 18*d*. As explained with reference to the designs shown in FIGS. 3 and 4, a grip sleeve 26*d* is supported in a radial direction 30*d* relative to absorber mass element 18*d* via damping elements 40*d* designed as elastomer rings. Absorber mass element 18*d* is supported via damping elements 38*d* designed as elastomer rings relative to a support element 72*d*, which is designed as a single piece with a fastening unit 58*d*. A receiving area 28*d* of an auxiliary handle 14*d* is designed open toward an end region 64*d* facing fastening unit 58*d* and toward an end region 66*d* facing away from fastening unit 58*d*, in the region of fastening unit 58*d*, absorber mass element 18*d* extends in axial direction 32*d* beyond auxiliary handle 14*d*.

In this region, absorber mass element 18*d* includes a peg-shaped, segment-like projection 44*d* that extends outwardly in radial direction 30*d*. Segment-like projection 44*d* extends along a maximum angular range of 45° in a circumferential direction 68*d*, and is provided to increase inertia and/or to produce an imbalance in order to absorb vibrations by generating a counter-oscillation. A fastening element 70*d* of fastening unit 58*d* includes a peg-shaped element 86*d* along axial direction 32*d*, 34*d* in the region of segment-like projection 44*d* of absorber mass element 18*d*. Peg-shaped element 86*d* extends radially outwardly from fastening element 70*d* and is located on a side of fastening element 70*d* opposite to segment-like projection 44*d*.

It will be understood that each of the elements described above, or two or more together, may also find a useful application in other types of constructions differing from the types described above.

While the invention has been illustrated and described as embodied in a auxiliary handle device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An auxiliary handle device, comprising an auxiliary handle said auxiliary handle including a central support element having an axis and extending in an axial direction, a grip sleeve extending in the axial direction and circumferentially surrounding said support element at a radial distance therefrom to form a radial space therebetween, a damping unit located radially between said grip element and said central support element in said radial space and including at least one absorber mass element configured in a shape of a sleeve and extending in the axial direction and a damping element configured to circumferentially surround said central support element and to support said at least one absorber mass element on said central support element, relative to said central support element, in a concentric way, wherein said central support element, said damping element, said absorber mass element, and said grip sleeve being located coaxially with each other, circumferentially surrounding each other, and extending in the axial direction over substantially a same axial length.

2. An auxiliary handle device as defined in claim 1, wherein said damping unit includes at least a second sleeve-shaped absorber mass element.

3. An auxiliary handle device as defined in claim 2, wherein at least one of said sleeve-shaped absorber mass elements is located at least partially inside a further sleeve-shaped absorber mass element.

4. An auxiliary handle device as defined in claim 3, wherein said damping element is arranged so that via said damping element said sleeve-shaped absorber mass element is supported inside the further sleeve-shaped absorber mass element.

5. An auxiliary handle device as defined in claim 2, wherein said absorber mass elements have different damping properties.

6. A hand-held power tool, comprising a main handle device; and an auxiliary handle device as defined in claim 1.

7. A hand-held power tool as defined in claim 6, wherein the hand-held power tool is configured as an angle grinder.

8. An auxiliary handle device as defined in claim 1, wherein said grip sleeve is supported in a direction selected from the group consisting of a radial direction, an axial direction, and both, via said absorber mass element.

9. An auxiliary handle device as defined in claim 1, wherein said damping element is configured a rolling element.

10. An auxiliary handle device as defined in claim 1, wherein said damping element is composed of an elastomer.

11. An auxiliary handle device as defined in claim 1, wherein said damping element is configured as a ring which extends in the axial direction and is coaxial with said grip sleeve, said damping element and said central support element.

12. An auxiliary handle device as defined in claim 1, wherein said damping unit includes at least one adjusting element for adjusting at least one damping parameter of said damping element.

13. An auxiliary handle device as defined in claim 1, wherein at least one of said absorber mass elements includes a segment-type extension in a radial direction.

14. An auxiliary handle device as defined in claim 1 further comprising a first end region facing a fastening unit of said auxiliary handle device and a second end region facing away from said fastening unit, wherein said support element extends from said first end region to said second end region.

* * * * *